US009188079B2

(12) United States Patent
Henne et al.

(10) Patent No.: US 9,188,079 B2
(45) Date of Patent: Nov. 17, 2015

(54) CYLINDER HEAD AND INTERNAL COMBUSTION ENGINE EQUIPPED THEREWITH

(75) Inventors: Ingo Henne, Shanghai (CN); Frank Schiefer, Augsburg (DE)

(73) Assignee: MAN Diesel & Turbo SE, Augsburg (DE)

( * ) Notice: Subject to any disclaimer, the term of this patent is extended or adjusted under 35 U.S.C. 154(b) by 406 days.

(21) Appl. No.: 13/806,179

(22) PCT Filed: Mar. 15, 2011

(86) PCT No.: PCT/DE2011/050006

§ 371 (c)(1), (2), (4) Date: Feb. 1, 2013

(87) PCT Pub. No.: WO2011/160624

PCT Pub. Date: Dec. 29, 2011

(65) Prior Publication Data

US 2013/0199505 A1 Aug. 8, 2013

(30) Foreign Application Priority Data

Jun. 24, 2010 (DE) ..... 10 2010 030 499

(51) Int. Cl.

| | |
|---|---|
| ***F02B 75/08*** | (2006.01) |
| ***F02F 1/42*** | (2006.01) |
| ***F02B 77/04*** | (2006.01) |
| *F02B 47/08* | (2006.01) |

(52) U.S. Cl.

CPC ..... *F02F 1/4285* (2013.01); *F02B 75/08* (2013.01); *F02B 77/04* (2013.01); *F02F 1/4257* (2013.01); *F02F 1/4292* (2013.01); *F02B 47/08* (2013.01)

(58) Field of Classification Search

CPC ..... F02F 1/4285; F02F 1/40; F02B 75/08; F02B 77/04; F02B 47/08; F02M 25/0747; F02M 25/0723; F02M 31/16; F02M 31/06

USPC ..... 123/568.13, 41.32, 41.82 R, 1 A, 540, 123/541, 542, 545, 556, 557

See application file for complete search history.

(56) References Cited

U.S. PATENT DOCUMENTS

| | | | | |
|---|---|---|---|---|
| 5,803,023 | A * | 9/1998 | Takahashi et al. | 123/41.01 |
| 6,319,080 | B1 * | 11/2001 | Watanabe et al. | 440/88 R |
| 7,121,907 | B2 * | 10/2006 | Tateishi et al. | 440/88 R |
| 7,438,787 | B2 * | 10/2008 | Mizuno et al. | 204/196.19 |
| 7,984,684 | B2 * | 7/2011 | Hinderks | 114/274 |

FOREIGN PATENT DOCUMENTS

| | | |
|---|---|---|
| DE | 18 67 233 | 12/1962 |
| DE | 31 27 082 | 1/1983 |
| DE | 43 44 356 | 7/1994 |
| DE | 44 09 750 | 9/1995 |
| DE | 199 02 678 | 7/2000 |
| DE | 697 09 530 | 11/2002 |
| DE | 10 2005 042 474 | 3/2007 |

* cited by examiner

*Primary Examiner* — Hai Huynh

(74) *Attorney, Agent, or Firm* — Cozen O'Connor

(57) ABSTRACT

A cylinder head and internal combustion engine outfitted therewith, in which the cylinder head has a plurality of media passages, at least one of which is for conducting a corrosive medium. Each media passage has a media contact surface for conducting a medium. The cylinder head has a longer service life due to the media contact surface of the at least one media passage for conducting the corrosive medium being formed of a corrosion-resistant material.

7 Claims, 2 Drawing Sheets

CYLINDER HEAD AND INTERNAL COMBUSTION ENGINE EQUIPPED THEREWITH

PRIORITY CLAIM

This is a U.S. national stage of International Application No. PCT/DE2011/050006, filed on 15 Mar. 15, 2011, which claims priority to German Application No. 10 2010 030499.9, filed 24 Jun. 2010, the contents of which are incorporated herein by reference.

BACKGROUND OF THE INVENTION

1. Field of the Invention

The invention is directed to a cylinder head and to an internal combustion engine outfitted with a cylinder head.

2. Description of the Related Art

A previously proposed cylinder head is described, for example, in German Published Patent Application No. 689 27 359 T2. Owing to the media flowing through the cylinder head, a cylinder head of this type is constantly exposed to wear, which can have a disadvantageous effect on the life of the cylinder head.

SUMMARY OF THE INVENTION

An object of the present invention is to provide a cylinder head having a longer service life. A further object of the present invention is to provide an internal combustion engine outfitted with a cylinder head of this kind.

A recent trend in the field of internal combustion engines is the development of exhaust gas recirculation systems. Since cylinder heads such as those used in large diesel engines, for example, are usually produced from cast iron, they are very susceptible to corrosion. In the course of the development of exhaust gas recirculation systems, this was recognized as one of the potential weak points, and the solution according to the present invention was developed for improving the resistance of the cylinder head to corrosion and therefore prolonging its service life.

Thus according to a first aspect of the present invention, a cylinder head for an internal combustion engine such as a large diesel engine in particular, e.g., for ship applications or power plant applications, has a plurality of media passages, each having a media contact surface provided for conducting a medium. The media contact surface of at least one media passage of the plurality of media passages which is provided for conducting a corrosive medium is formed of corrosion-resistant material.

Through the corrosion-resistant material, this media passage is reliably and permanently protected against possible corrosive wear due to the corrosive medium so that the media passage and, therefore, the entire cylinder head has a longer service life.

The corrosion-resistant material is preferably a corrosion-resistant cast iron such as, e.g., austenitic cast iron with spheroidal graphite (e.g., EN-GJSA-XNiCr20-2 or EN-GJSA-XNiSiCr35-5-2). Naturally, other corrosion-resistant materials such as corrosion-resistant steel, for example, may also be used according to the present invention.

According to an embodiment of the present invention, the media contact surface of all of the media passages of the plurality of media passages provided for conducting corrosive media is formed of corrosion-resistant material.

In this way, the cylinder head is reliably and permanently protected in all of its corrosively loaded media passages so that the cylinder head has an even longer service life.

According to another embodiment of the present invention, every media passage of the plurality of media passages which has a media contact surface formed of corrosion-resistant material is lined with corrosion-resistant material.

This advantageously allows such a media passage itself or the cylinder head itself to be produced from a different, possibly inexpensive material so that the cylinder head in its entirety is more economical while guaranteeing protection against corrosion. The cylinder head is preferably produced from inexpensive material which is susceptible to corrosion.

According to another embodiment of the present invention, the cylinder head is produced from cast material, e.g., EN-GJS-400-15 (GGG-40), and the corrosion-resistant material of every media contact surface formed by corrosion-resistant material is cast into the respective media passage.

In this way, the cylinder head itself can be produced inexpensively and so as to be adapted to the high compressive stresses during operation, and protection against corrosion is simultaneously guaranteed in a simple manner for the corrosively loaded media passages.

According to yet another embodiment of the present invention, every media passage having a media contact surface formed by a corrosion-resistant material has a port arrangement or pipe arrangement which is produced from the corrosion-resistant material and which is embedded in the cylinder head. An inner circumference of the pipe arrangement forms the media contact surface formed of corrosion-resistant material.

The pipe arrangement preferably has at least one pipe or possibly a plurality of pipes which are joined to one another in a media-tight manner so that the entire media passage to be protected against corrosion is lined with pipe produced from corrosion-resistant material.

According to a further embodiment of the present invention, the pipe arrangement is provided with at least one sealing surface on the media input side and/or on the media output side so as to ensure that a corrosive medium to be conducted through the pipe arrangement of the media passage is inputted and/or outputted in a media-tight manner.

In an advantageous manner, this affords a reliable possibility for connection of respective corrosive media to the cylinder head.

According to another embodiment of the present invention, the at least one media passage of the plurality of media passages which has a media contact surface formed of corrosion-resistant material is constructed as an air inlet passage and particularly as a charge-air inlet passage.

According to yet another embodiment of the present invention, exclusively media contact surface of the media passage of the cylinder head according to the embodiments of the invention described above, which media passage is formed as air inlet passage or charge-air inlet passage, is formed of corrosion-resistant material. That is, according to this embodiment of the present invention, a pipe arrangement as described above which is produced from corrosion-resistant material is preferably embedded in or cast into exclusively the media passage formed as air inlet passage or charge-air inlet passage.

When using an exhaust gas recirculation system, the air inlet passage or charge-air inlet passage especially is a media passage which is particularly corrosively loaded by the recirculated exhaust gas. As a result of the corrosion protection of this media passage according to the present invention, this media passage is reliably protected against corrosive wear so that the exhaust gas recirculation system can be used without negatively affecting the service life of the cylinder head, and pollutant emissions of an internal combustion engine outfitted with the cylinder head according to the invention can accordingly be reduced.

The present invention also extends to embodiment forms which are not given by combinations of features from explicit references to the claims so that the disclosed features of the invention can be combined with one another in any manner insofar as technically meaningful.

According to a second aspect of the present invention, an internal combustion engine having a cylinder head according to one or more or all of the above-described embodiments of the present invention in any conceivable combination is provided, the internal combustion engine is provided with an exhaust gas recirculation system, and the at least one media passage having a media contact surface formed by corrosion-resistant material is connected to the exhaust gas recirculation system as cylinder head input (particularly as charge-air inlet passage) for an exhaust gas/air mixture.

DETAILED DESCRIPTION OF THE PREFERRED EMBODIMENTS

Figure 1:
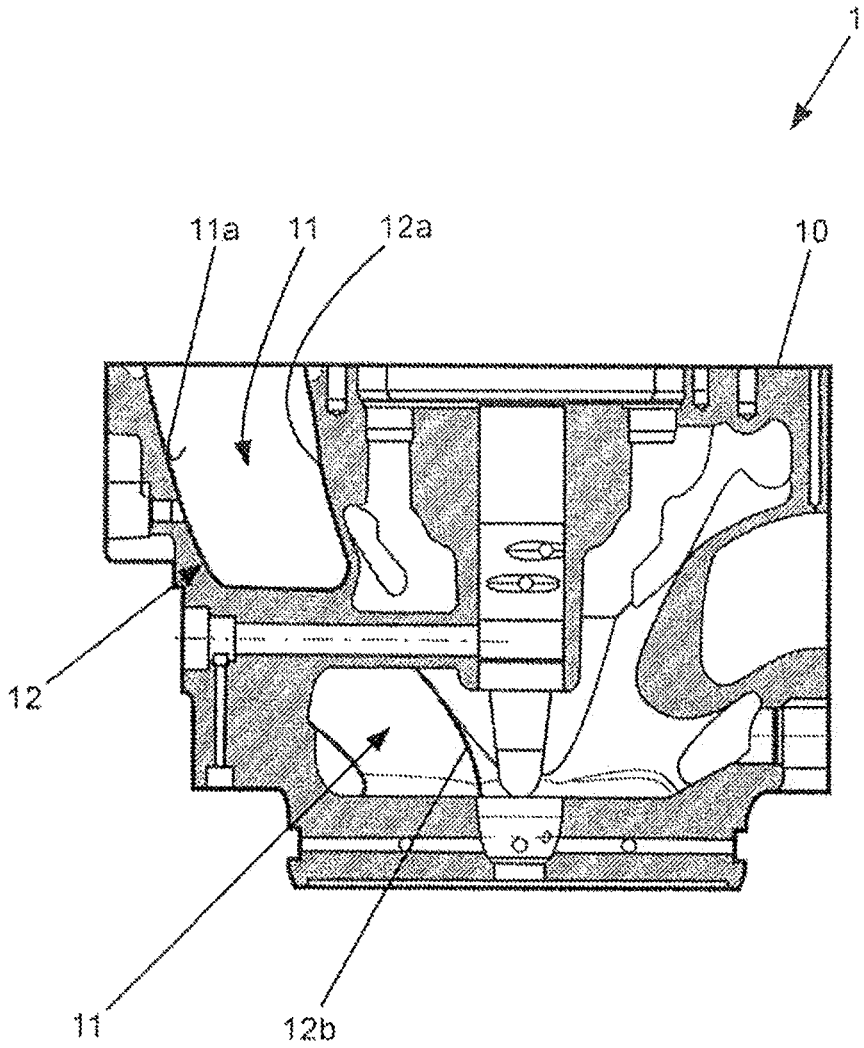
FIG. 1 shows a side sectional view of a cylinder head of an internal combustion engine according to an embodiment present of the invention.
Figure 2:
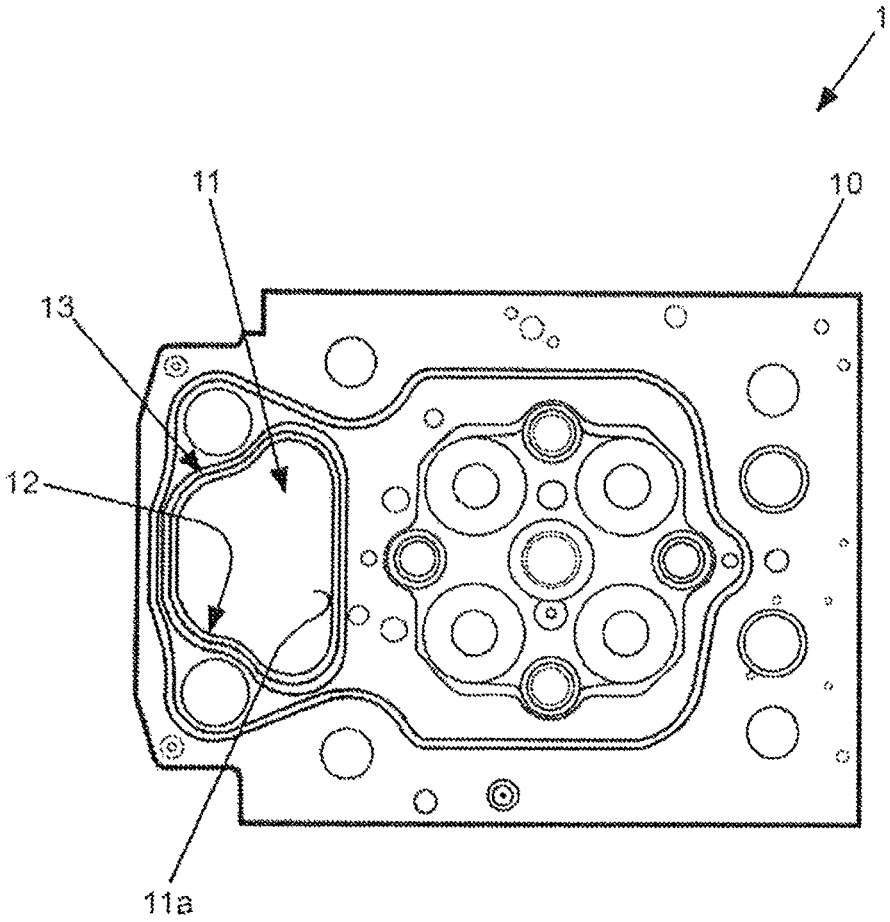
FIG. 2 shows a top view of the cylinder head of FIG. 1.

FIGS. 1 and 2 show views of a cylinder head 10 of a turbocharged internal combustion engine 1 (not shown in its entirety) according to an embodiment of the present invention. The internal combustion engine 1 is constructed as a large diesel engine such as is used in ship applications and power plant applications, for example.

The internal combustion engine 1 is outfitted with an exhaust gas recirculation system (not shown) whose basic operation is described, e.g., in German Patent No. 4231 218 C1 or German Published Patent Application No. 10 2005 017 905 A1.

The cylinder head 10 is produced from inexpensive cast material which is susceptible to corrosion, preferably EN-GJS-400-15 (GGG-40).

The cylinder head 10 of the internal combustion engine 1 has a plurality of media passages (only one media passage 11 is designated), each having a media contact surface provided for conducting a medium.

According to this embodiment of the present invention, the media contact surface 11*a* of at least one media passage 11 provided for conducting corrosive media is formed by corrosion-resistant material. Austenitic cast iron with spheroidal graphite (e.g., EN-GJSA-XNiCr20-2 or EN-GJSA-XNiSiCr35-5-2) is preferably provided as corrosion-resistant material.

In the embodiment shown in the drawings, the media passage 11 having the media contact surface 11*a* formed by corrosion-resistant material is connected to the exhaust gas recirculation system as a cylinder head input or charge-air inlet passage for an exhaust gas/air mixture (as corrosive media). Therefore, the media passage 11 formed as charge-air inlet passage is exposed to corrosive stress by the recirculated exhaust gas.

According to the embodiment of the present invention described with reference to FIGS. 1 and 2, the media passage 11 formed as charge-air inlet passage is lined with the corrosion-resistant material. More precisely, the corrosion-resistant material in the form of a pipe arrangement 12 produced from the corrosion-resistant material is embedded in the cylinder head 10, i.e., is cast into the media passage 11 formed as charge-air inlet passage, and an inner circumference (not designated separately) of the pipe arrangement 12 forms the media contact surface 11*a* formed by corrosion-resistant material.

According to the embodiment of the present invention described in FIGS. 1 and 2, the pipe arrangement 12 has a plurality of pipes 12*a*, 12*b* which are joined to one another in a media-tight manner so that the entire media passage 11 which is formed as charge-air inlet passage and which is to be protected against corrosion is lined with pipe produced from the corrosion-resistant material.

As can be seen from FIG. 2, the pipe arrangement 12 is provided with a sealing surface on the media input side and on the media output side (only the sealing surface 13 on the media input side is shown in FIG. 2) so as to ensure that a corrosive medium to be conducted through the pipe arrangement 12 of the media passage 11 formed as charge-air inlet passage is inputted and outputted in a media-tight manner.

According to an embodiment of the present invention, the media contact surface of all of the other media passages of the cylinder head 10 which are provided for conducting corrosive media, e.g., a coolant passage and an exhaust gas output passage, is formed of corrosion-resistant material. Each of these additional media passages is preferably also lined with corrosion-resistant material as was described above in the form of a pipe arrangement 12 cast into the cylinder head 10.

Finally, according to an embodiment of the present invention, a corrosion-resistant material such as cast iron (the exact quality of which is to be selected depending on the corrosive medium) is cast into the regions of the cylinder head 10 which are affected by corrosive attack (i.e., the intake port, for example). Since the corrosion-resistant material is very expensive, the entire cylinder head 10 should not be produced and cast from this material for reasons of economy. This is advantageously ensured by to the present invention as embodied in FIGS. 1 and 2.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A cylinder head for an internal combustion engine, comprising:

a plurality of media passages, each media passage having a media contact surface for conducting a corrosive medium, the media contact surface of at least one of the plurality of media passages being formed of a corrosion-resistant material, wherein every media passage having the media contact surface formed by the corrosion-resistant material includes a pipe arrangement produced from the corrosion-resistant material, the pipe arrangement being embedded in the cylinder head, wherein an inner circumference of the pipe arrangement forms the media contact surface formed of the corrosion-resistant material, and wherein the pipe arrangement includes at least one sealing surface on at least one selected from the group consisting of a media input side and a media output side configured so as to ensure that the corrosive medium to be conducted through the pipe arrangement of the media passage is at least one selected from the group consisting of inputted and outputted in a media-tight manner.

2. The cylinder head according to claim 1, wherein the media contact surface of all of the plurality of media passages is formed of the corrosion-resistant material.

3. The cylinder head according to claim 1, wherein every media passage of the plurality of media passages which has the media contact surface formed of the corrosion-resistant material is lined with the corrosion-resistant material.

4. The cylinder head according to claim 1, wherein the cylinder head is produced from material which is susceptible to corrosion.

5. The cylinder head according to claim 1, wherein the cylinder head is produced from a cast material, and wherein the corrosion-resistant material of every media contact surface formed by the corrosion-resistant material is cast into a respective one of the plurality of media passages.

6. The cylinder head according to claim 1, wherein the at least one media passage of the plurality of media passages having the media contact surface formed by the corrosion-resistant material is constructed as an air inlet passage.

7. An internal combustion engine, comprising:

a cylinder head according to claim 1; and an exhaust gas recirculation system, wherein the at least one media passage of the media contact surface formed by the corrosion-resistant material is connected to the exhaust gas recirculation system as a cylinder head input for an exhaust gas/air mixture.

* * * * *